United States Patent [19]

Cuhel

[11] Patent Number: 4,662,527

[45] Date of Patent: May 5, 1987

[54] HYDRAULIC CIRCUIT FOR SELF-UNDECKING CRANE

[75] Inventor: Leon L. Cuhel, Cedar Rapids, Iowa

[73] Assignee: FMC Corporation, Chicago, Ill.

[21] Appl. No.: 864,364

[22] Filed: May 19, 1986

Related U.S. Application Data

[62] Division of Ser. No. 731,753, May 7, 1985, Pat. No. 4,632,261.

[51] Int. Cl.[4] ..... B66C 23/44

[52] U.S. Cl. ..... 212/180; 212/189

[58] Field of Search ..... 212/175, 179–181, 212/189

[56] References Cited

U.S. PATENT DOCUMENTS

| | | | |
|---|---|---|---|
| 3,814,265 | 6/1974 | Miller | 212/238 |
| 3,856,152 | 12/1974 | Parrett et al. | 212/189 |
| 3,941,252 | 3/1976 | Six et al. | 212/181 |
| 4,124,226 | 11/1978 | Phillips | 212/189 |
| 4,273,244 | 6/1981 | Jensen et al. | 212/189 |
| 4,318,550 | 3/1982 | Jacobsen | 280/766 |

*Primary Examiner*—Joseph F. Peters, Jr.
*Assistant Examiner*—Stephen P. Avila
*Attorney, Agent, or Firm*—Ronald C. Kamp; Richard B. Megley

[57] ABSTRACT

A self undecking crane in which the upper is separable from the lower and is supported on legs which are swingable from a stowed position to an operable position by cylinders. Hydraulic jacks on the ends of the legs raise and lower the upper relative to the lower. A hydraulic circuit controls extension and retraction of the cylinders and the jacks and includes a blocking valve which senses pressure in the jacks and precludes movement of the cylinder when the jacks are subjected to high pressure.

4 Claims, 3 Drawing Figures

HYDRAULIC CIRCUIT FOR SELF-UNDECKING CRANE

This is a division of application Ser. No. 731,753, filed May 7, 1985 now U.S. Pat. No. 4,632,261.

This invention relates to a hydraulic circuit for self-undecking cranes, and more particularly, to a hydraulic circuit for such cranes which utilize swingably deployable legs to support the upper during the self-undecking procedure.

Figure 1:
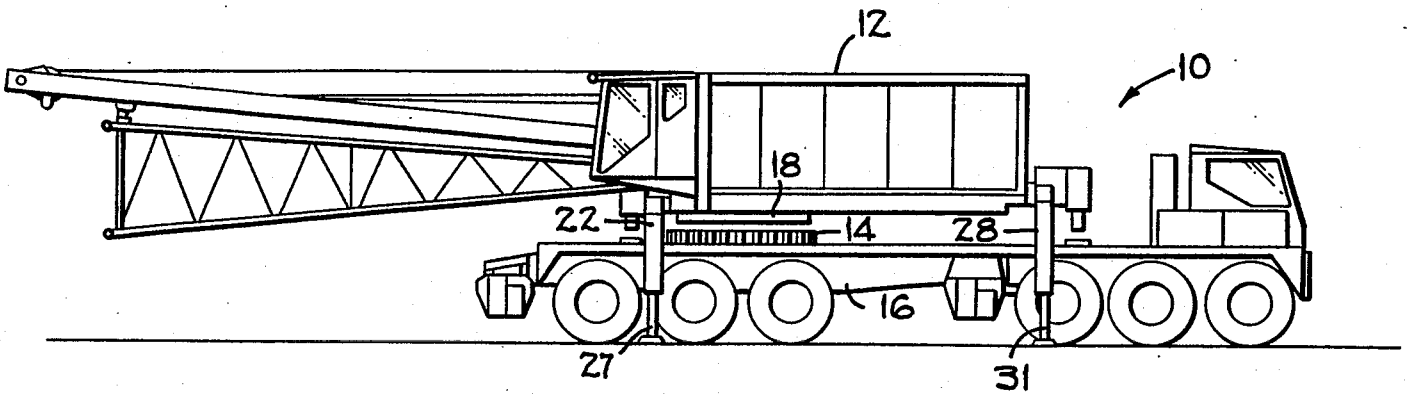
FIG. 1 is a side elevational view of a self-undecking crane incorporating the present invention.
Figure 2:
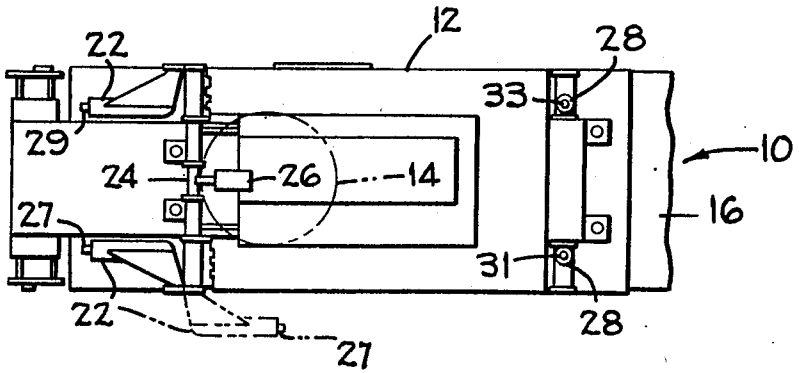
FIG. 2 is a top plan view of the crane shown in FIG. 1 with portions thereof broken away and eliminated.
Figure 3:
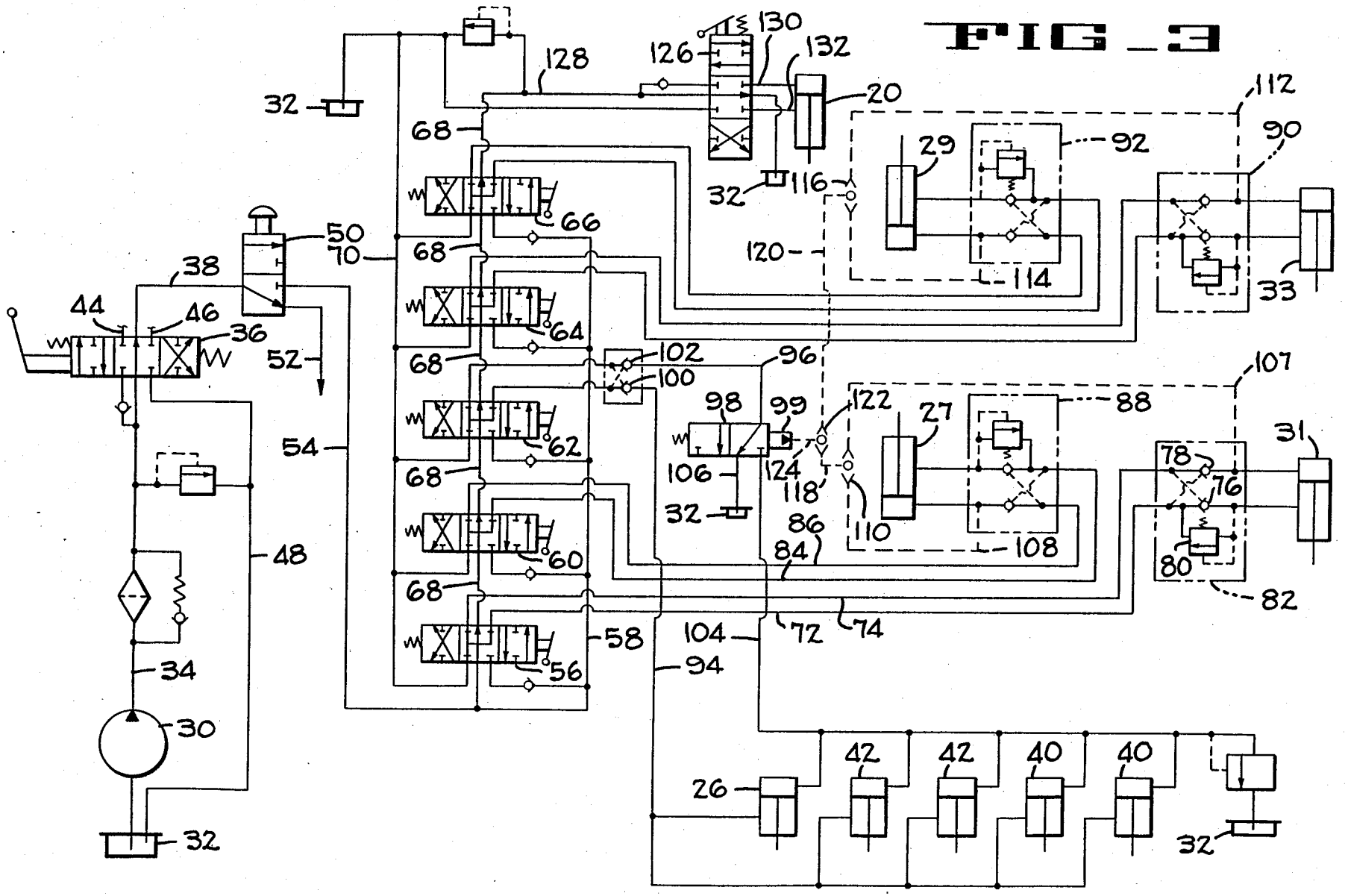
FIG. 3 is a schematic diagram of a hydraulic circuit according to the present invention.

The self-undecking crane, indicated generally at 10 in FIGS. 1 and 2, includes an upper works 12 rotatably mounted by means of a turntable bearing 14 on a lower works or carrier 16. A ring 18 mounted on the upper 12 is releaseably secured to the inner race of the turntable bearing 14, such as, for example, shown in U. S. Pat. No. 3,923,407, issued Dec. 2, 1975 to L. B. Jensen and R. E. Thune, wherein a locking ring, actuated by a hydraulic cylinder, is expanded to lock the ring to the inner race and contracted to unlock the same. This hydraulic cylinder, while not shown in FIGS. 1 and 2, is shown in FIG. 3 at 20. With the cylinder 20 contracted the turntable bearing 14 is released from the ring 18 and the upper 12 may be separated from and elevated above the carrier 16, as shown in FIG. 1.

A pair of legs 22 are mounted to a cross tube 24 and are manually pivotable about a vertical axis between a stowed position, as shown by the solid line position in FIG. 2 and an outward position, as shown in phantom line in FIG. 2. The legs 22 are pinned or otherwise secured in these two positions. A hydraulic cylinder 26 is connected through a crank arm to the cross tube 24. Retraction of the hydraulic cylinder 26 will rotate the cross tube 24 and the attached legs 22 from their outward, rearward (relative to the upper 12) extending position shown in phantom line in FIG. 2 to a vertical position as shown in FIG. 1. Extension of the cylinder 26 will return the legs 22 from vertical orientation to a substantially horizontal position. Hydraulic jacks 27 and 29 are incorporated into and extend from the free end of the front legs 22.

A pair of rear legs 28, each leg being L-shaped, are pivotably mounted on the rear of the upper 12. A pair of cylinders (not shown in FIGS. 1 and 2, but identified in FIG. 3 at 40 and 42) are operatively connected to each leg 28 and rotate the legs through 180 degrees between an upright stowed position, as shown in FIG. 2, and an outward operative position, as shown in FIG. 1. Each of the pair of cylinders 40 and 42 has one cylinder positioned inside the horizontal portion of the L-shaped leg and pinned between that portion and a link member pivotably secured to the hinge connection of the leg to a hollow beam on the upper 12. The other cylinder of each pair is positioned inside the hollow beam and is pinned between the link member and the beam. Contraction of both cylinders in each pair of cylinders 40 and 42 will cause that leg 28 with which they are associated to rotate to the outward, operative position, and extension of both will rotate that leg to its inward, stowed position. A pair of jacks 31 and 33 are incorporated into and extend from the free end of each of the rear legs 28.

A pump 30, driven by an engine on the upper 12, draws hydraulic fluid from a reservoir 32 and discharges fluid under pressure through a conduit 34 to a closed-center, power-beyond, control valve 36. The valve 36 provides power-beyond capability through conduit 38 and controls the raising and lowering of the cranes' counterweight through conduit 44 and 46. A conduit 48 connects the valve 36 with the reservoir 32. The conduit 38 connects with a two-position valve 50 to which conduits 52 and 54 are also connected. With the valve 50 in its upward position, as shown in FIG. 3, conduit 54 is blocked and conduit 52 is in communication with conduit 38 to supply hydraulic fluid pressure from the pump 30 to other hydraulic components on the upper 12, such as for example, the hydraulic disk brake circuit for the draw works as disclosed in U.S. patent application, Ser. No. 487,639 filed Apr. 22, 1983. The conduit 54 connects with the power-beyond port of control valve 56 and branches into parallel pressure passage 58. The control valve 56 is in a valve bank including valves 60, 62, 64, and 66. A power-beyond passage 68 connects between these valves and the parallel pressure passage 58 connects with each valve through a check valve. A return conduit 70 is also connected to each of these valves.

The valve 56 is also connected through conduits 72 and 74 with the rod and head ends respectively of the jack 31. A pair of pilot-operated check valves 72 and 74 are interposed in conduits 76 and 78 respectively with each check valve piloted off the other conduit. With the valve 56 positioned as shown in FIG. 3, the conduits 72 and 74 are connected with the reservoir 32 through conduit 70 and the check valves 76 and 78 are seated to hydraulically lock the jack 31. Shifting the valve 56 to the left will connect the rod end of jack 31 with pump pressure through conduit 72. This pressure will unseat check valve 76 and will be directed as a pilot pressure to unseat check valve 78; the head end of jack 31 thereby being connected to the reservoir 32. The jack 31 will therefore be contracted. Shifting the valve 56 to the right will connect conduit 74 with pump pressure and open the pilot check valve 76. The jack 31 will thereby be extended. A thermal expansion, pressure relief valve 80 is connected across the check valve 76 to permit the exhaust of hydraulic fluid due to fluid expansion from heat, such as exposure to the sun, through conduit 72 and the open center valve 56 to the reservoir 32 through conduit 70. The pilot check valves 76 and 78 and the relief valve 80 are preferably incorporated into a valve block 82 physically attached to the jack 31.

The valve 60 is connected through conduits 84 and 86 to the rod and head ends respectively of jack 27, with a valve block 88 interposed therein. The valve 60 controls the extension and retraction of jack 27 in the same way as valve 56 controls jack 31. Similarly, control valves 64 and 66 are arranged to control the extension and retraction of jacks 33 and 29 respectively with similar valve blocks 90 and 92 attached to the associated jacks and interposed between the valves and the jacks.

The control valve 62 is connected via conduit 94 to the rod end of each of the cylinders 26, 42, and 40, while conduit 96 connects this valve with a two position valve 98. A pair of pilot-operated check valves 100 and 102 are interposed in conduits 94 and 96 respectively and are piloted off the pressure in the other conduit. The valve 98 is spring biased toward the right, as viewed in FIG. 3, wherein conduit 96 connects with a conduit 104, which connects with the head end of each of the cylinders 26, 42, and 40, and a conduit 106 leading to reservoir 32 is blocked. When shifted to the left, i.e. the position shown in FIG. 3, under the influence of pressure acting through actuator 99, the valve 98 connects conduits 96 and 104, and blocks conduit 106. The pressure to actuator 99 is provided from the one of jacks 27, 31, 29 and 33 having the highest pressure in its head end, in which end pressure is created when resistance to extension is encountered. A pilot line 107 sensing the pressure in the head end of jack 31 and a pilot line 108 sensing the pressure in the head end of jack 27 are connected to opposite ends of a shuttle valve 110. Similarly, pilot lines 112 and 114 sensing the pressure in the head end of jacks 33 and 29 respectively are connected to opposite ends of shuttle valve 116. The central connection of shuttle valves 110 and 116 are connected through pilot lines 118 and 120 respectively to a third shuttle valve 122, the central connection of which connects with actuator 99 through pilot line 124. The shuttle valve 110 transmits the higher of the two pressures in the head end of jacks 31 and 27 to the shuttle valve 122, while the shuttle valve 116 transmits the higher pressure in jacks 33 and 29 to the shuttle valve 122. The latter valve transmits to the actuator 99 the higher of the pressures in pilot lines 118 and 120. The actuator 99 then shifts the valve 98, against its spring bias, to the left when the pressure received thereby exceeds a predetermined pressure. When so shifted, pressure communication between the control valve 62 and the head end of cylinders 26, 42 and 40 is precluded. Consequently, these cylinders cannot be extended, even though the valve 62 is shifted to the right, when the pressure in the head end of any one of the jacks exceeds a predetermined pressure. The importance of this arrangement is that an inadvertant retraction of the legs 22 and 28 is precluded whenever one of the jacks 27, 29, 31 and 33 has been extended with sufficient pressure to support at least a portion of the upper's weight.

A closed-center, power-beyond, control valve 126 receives fluid pressure from the power-beyond port of valve 66 through conduit 128 and is connected to the head and rod ends of cylinder 20 through conduits 130 and 132 respectively. The locking ring, to which cylinder 20 is connected, is released or unlocked from the turntable bearing 14 by shifting the valve 126 upward to pressurize conduit 132 and the rod end of cylinder 20. Shifting valve 126 downward will pressurize the head end of cylinder 20 through conduit 130 extending the cylinder and causing the locking ring to latch or lock the ring 18 to the turntable 14.

The present invention provides a circuit which minimizes the possibility of imposing the weight of the upper on supporting legs when the legs are oriented in other than a vertical orientation. Consequently, the invention precludes damaging the upper legs through imposition of bending loads thereon. In addition, the upper when supported on the legs is maintained in a stable configuration and the possibility of accidentally dropping the upper onto the ground or the carrier is minimized.

While a preferred embodiment of the present invention has been shown and described herein, it will be appreciated that various changes and modifications may be made therein without departing from the spirit of the invention as defined by the scope of the appended claims.

What is claimed is:

1. In a self-undecking crane having an upper separable from a carrier, a front pair of swingably retractable legs and a rear pair of swingably retractable legs; and an engine-driven pump on the upper; comprising:

a cylinder for swinging said front legs to a vertical orientation;

cylinder means arranged to swing said rear legs to a vertical orientation;

a jack incorporated into each leg for elevating said upper above said carrier;

a cylinder control valve for selective connection of said pump and said cylinder and cylinder means for actuation thereof;

jack control valve means for selective connection of said pump and said jacks for extension thereof; and a blocking valve responsive to pressure in said jacks for blocking communication between said cylinder valve and said cylinder and cylinder means.

2. The invention according to claim 1, and further comprising; a plurality of shuttle valves for directing the pressure in the jack with the highest pressure to said blocking valve.

3. The invention according to claim 2, and further comprising; pilot operated check valve means associated with each jack to hydraulically lock said jack in the absence of pressure from said pump.

4. The invention according to claim 3, and further comprising:

a lock ring cylinder for unlocking said upper from said carrier; and a lock ring control valve for selectively connecting said pump to said cylinder.

* * * * *